US011168587B2

(12) United States Patent
Kawano et al.

(10) Patent No.: US 11,168,587 B2
(45) Date of Patent: Nov. 9, 2021

(54) STEAM TURBINE DIAPHRAGM MANUFACTURING METHOD

(71) Applicant: Mitsubishi Power, Ltd., Yokohama (JP)

(72) Inventors: Takanori Kawano, Yokohama (JP); Naoto Kubo, Yokohama (JP); Nozomu Ogasawara, Yokohama (JP)

(73) Assignee: Mitsubishi Power, Ltd., Yokohama (JP)

( * ) Notice: Subject to any disclaimer, the term of this patent is extended or adjusted under 35 U.S.C. 154(b) by 0 days.

(21) Appl. No.: 17/258,698

(22) PCT Filed: Dec. 4, 2019

(86) PCT No.: PCT/JP2019/047495

§ 371 (c)(1),
(2) Date: Jan. 7, 2021

(87) PCT Pub. No.: WO2020/174801

PCT Pub. Date: Sep. 3, 2020

(65) Prior Publication Data

US 2021/0285339 A1 Sep. 16, 2021

(30) Foreign Application Priority Data

Feb. 27, 2019 (JP) ..... JP2019-034598

(51) Int. Cl.
*F01D 25/24* (2006.01)
*F01D 11/08* (2006.01)

(52) U.S. Cl.
CPC ..... *F01D 25/243* (2013.01); *F01D 11/08* (2013.01); *F01D 25/246* (2013.01);
(Continued)

(58) Field of Classification Search
CPC ..... F01D 25/243; F01D 11/08; F01D 25/246; F05D 2260/31; F05D 2240/55; F05D 2230/60
See application file for complete search history.

(56) References Cited

U.S. PATENT DOCUMENTS 5,149,248 A * 9/1992 Cramer ..... F01D 25/243 29/889.21
5,501,573 A 3/1996 Sanders
(Continued)

FOREIGN PATENT DOCUMENTS

JP 60-34502 U 3/1985
JP 4-308304 A 10/1992
(Continued)

OTHER PUBLICATIONS

International Search Report (PCT/ISA/210) issued in PCT Application No. PCT/JP2019/047495 dated Feb. 18, 2020 with English translation (five (5) pages).
(Continued)

*Primary Examiner* — Eldon T Brockman
(74) *Attorney, Agent, or Firm* — Crowell & Moring LLP

(57) ABSTRACT

A steam turbine diaphragm including a diaphragm inner ring, a diaphragm outer ring, and a blade section that are formed integrally includes: a collector ring that retains a seal fin having a radial spill strip structure; and an adapter ring interposed between the diaphragm outer ring and the collector ring. The collector ring and the adapter ring have external radii that are larger than an external radius of the diaphragm outer ring. The diaphragm outer ring and the adapter ring are mutually coupled by a plurality of first bolts. Facing surfaces of the diaphragm outer ring and the adapter ring are kept together tightly and sealed. The collector ring and the adapter ring are mutually coupled by a plurality of second bolts that are inserted at positions on an outer circumference side of the seal fin.

5 Claims, 6 Drawing Sheets

(52) U.S. Cl.
CPC ..... *F05D 2220/31* (2013.01); *F05D 2230/60* (2013.01); *F05D 2240/55* (2013.01); *F05D 2260/31* (2013.01)

(56) References Cited

U.S. PATENT DOCUMENTS

| | | | | |
|---|---|---|---|---|
| 8,105,023 | B2 * | 1/2012 | Ikeda | F01D 11/001 415/170.1 |
| 9,938,841 | B2 * | 4/2018 | Stafford | F01D 25/12 |
| 2008/0175706 | A1 | 7/2008 | Ikeda et al. | |
| 2020/0040733 | A1 | 2/2020 | Stanka et al. | |

FOREIGN PATENT DOCUMENTS

| | | | |
|---|---|---|---|
| JP | 2008-169705 | A | 7/2008 |
| JP | 2016-194306 | A | 11/2016 |
| JP | 2018-168844 | A | 11/2018 |
| WO | WO 2018/184788 | A1 | 10/2018 |

OTHER PUBLICATIONS

Japanese-language Written Opinion (PCT/ISA/237) issued in PCT Application No. PCT/JP2019/047495 dated Feb. 18, 2020 (three (3) pages).

* cited by examiner

STEAM TURBINE DIAPHRAGM MANUFACTURING METHOD

TECHNICAL FIELD

The present invention relates to a steam turbine diaphragm manufacturing method.

BACKGROUND ART

In a steam turbine, a structure in which seal fins to seal the gaps between diaphragm outer rings and moving blade tips are embedded in the diaphragm outer rings is adopted in some cases (see Patent Document 1, and the like).

PRIOR ART DOCUMENT

Patent Document
Patent Document 1: JP-2016-194306-A

SUMMARY OF THE INVENTION

Problem to be Solved by the Invention

In a steam turbine, diaphragms have heat drops, and particularly on the downstream side of the steam turbine, steam is condensed, and a lot of drain water is generated. There is a fear that if the generated drain water collides with moving blades located on the downstream side of the diaphragms, erosion of the moving blades occurs. Since the drain water is carried along the side surfaces of diaphragm outer rings and along the circumferential direction, collector rings are installed for the purpose of collecting the drain water without allowing the drain water to hit the tips of the moving blades. However, part of the drain water carried along the line of flow collides with and adheres to the moving blades, and furthermore the drain water adhered to the moving blades is scattered radially outward due to the centrifugal force. Accordingly, there is a concern particularly over the occurrence of erosion of the inner surfaces of the collector rings near seal fins facing the moving blades.

During operation, the drain water adhered to the moving blade surfaces is scattered radially outward due to the centrifugal force at a wet stage in a steam turbine. Accordingly, erosion of diaphragm outer rings occurs particularly near seal fins facing the moving blades in some cases. In view of this, a part to retain seal fins is formed as a separate member as a collector ring, and this is coupled to a diaphragm outer ring by bolts in some cases. In the case of this configuration, if erosion of sections facing moving blades has continued, it is not necessary to replace the entire diaphragm with a new product, and only the collector ring on which the erosion has continued has to be replaced.

Here, although there are some existing steam turbines with conventional structures in which seal fins are embedded in collector rings from the internal radius side and crimped, crimped portions at which the collector rings and the seal fins engage are exposed directly to drain water that is scattered thereon from moving blades. One of solutions for improvement of the reliability of such engagement sections between seal fins and collector rings is a conversion of the structure of seal fins to a radial spill strip (RSS) structure.

However, seal fins having the RSS structure have root sections to be inserted into a collector ring that are larger than embedment-type seal fins of the same class. In a case where the structure of seal fins is converted to the RSS structure, the pitch circle diameter (P.C.D.) of bolts that couple a collector ring to a diaphragm outer ring needs to be increased in order to avoid interference with root sections of the seal fins having increased sizes. However, a thickness that is large enough to tolerate an increase in the P.C.D of bolts is not left in the external radius of an existing diaphragm outer ring, or bolts interfere with a slit in some cases. In this case, a diaphragm outer ring that tolerates the increased P.C.D. of bolts needs to be fabricated newly, but the diaphragm outer ring is part of the diaphragm having a configuration made of one body. Accordingly, in actual situations currently, when the external radius of a diaphragm outer ring is to be increased, the entirety of a diaphragm, including its blade sections and diaphragm inner ring, is fabricated newly by spending a long construction period.

An object of the present invention is to provide a steam turbine having a structure with which it can be expected to enhance the reliability of a structure to fix seal fins, and significantly reduce construction periods, and a diaphragm manufacturing method.

Means for Solving the Problem

In order to achieve the object described above, the present invention provides a steam turbine diaphragm including a diaphragm inner ring, a diaphragm outer ring and a blade section that are formed integrally, the steam turbine diaphragm further including: a collector ring arranged on a downstream side of the diaphragm outer ring; a seal fin having a radial spill strip structure fit into the collector ring; and an adapter ring interposed between the diaphragm outer ring and the collector ring. The diaphragm outer ring and the adapter ring are mutually coupled by a plurality of first bolts inserted in an axial direction from a downstream side, and facing surfaces of the diaphragm outer ring and the adapter ring are kept together tightly and sealed. The collector ring and the adapter ring have external radii larger than an external radius of the diaphragm outer ring, and are mutually coupled by a plurality of second bolts that are inserted in the axial direction from the downstream side at positions on an outer circumference side of the seal fin.

Advantages of the Invention

According to the present invention, it can be expected to enhance the reliability of a structure to fix seal fins, and significantly reduce a construction period.

MODES FOR CARRYING OUT THE INVENTION

Hereinafter, embodiments of the present invention are explained by using the drawings.

—Steam Turbine Power Generation Facility—

Figure 1:
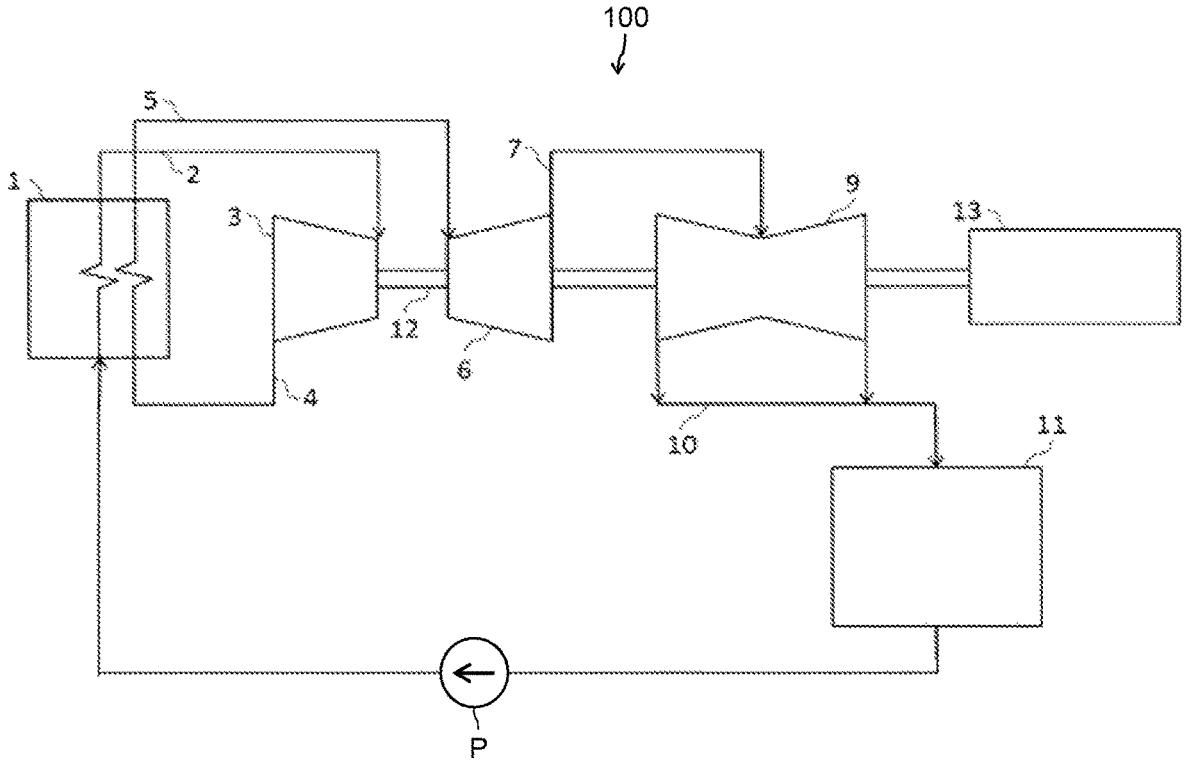
FIG. 1 is a schematic diagram of a steam turbine facility according to one embodiment of the present invention.

FIG. 1 is a schematic diagram of a steam turbine facility according to one embodiment of the present invention. A steam turbine power generation facility 100 illustrated in the figure includes a steam source 1, a high-pressure turbine 3, an intermediate-pressure turbine 6, a low-pressure turbine 9, a condenser 11, and a load device 13. In the following, the direction of the flow of steam which is a working fluid in each turbine is used as a reference direction. Regarding the low-pressure turbine 9 (FIG. 2), the direction of the flow of a main flow of steam S flowing through a working fluid flow passage F is a reference direction.

The steam source 1 is a boiler which heats water supplied from the condenser 11, and generates high-temperature, high-pressure steam. The steam generated at the steam source 1 is guided to the high-pressure turbine 3 via a main steam pipe 2, and drives the high-pressure turbine 3. The steam whose pressure has been reduced after driving the high-pressure turbine 3 is guided to the steam source 1 via a high-pressure turbine exhaust pipe 4, is heated again, and turns into reheat steam.

The reheat steam generated at the steam source 1 is guided to the intermediate-pressure turbine 6 via a reheat steam pipe 5, and drives the intermediate-pressure turbine 6. The steam whose pressure has been reduced after driving the intermediate-pressure turbine 6 is guided to the low-pressure turbine 9 via an intermediate-pressure turbine exhaust pipe 7, and drives the low-pressure turbine 9. The steam whose pressure has been reduced after driving the low-pressure turbine 9 is guided to the condenser 11 via a diffuser. The condenser 11 includes a coolant line (not illustrated), and causes the steam having been guided to the condenser 11 and a coolant flowing in the coolant line to exchange heat to condense the steam into water. The water condensed at the condenser 11 is fed to the steam source 1 by a water feeding pump P again.

Turbine rotors 12 of the high-pressure turbine 3, the intermediate-pressure turbine 6, and the low-pressure turbine 9 are mutually coupled coaxially. A load device (typically, a generator) 13 is coupled to the turbine rotors 12, and is driven by the rotational output power of the high-pressure turbine 3, the intermediate-pressure turbine 6, and the low-pressure turbine 9.

Note that instead of the generator, a pump is adopted as the load device 13 in some cases. In addition, although the high-pressure turbine 3, the intermediate-pressure turbine 6, and the low-pressure turbine 9 are included in the illustrated configuration, the intermediate-pressure turbine 6 is omitted in another possible configuration, for example. Although the high-pressure turbine 3, the intermediate-pressure turbine 6, and the low-pressure turbine 9 drive the single load device 13 in the illustrated configuration, each of the high-pressure turbine 3, the intermediate-pressure turbine 6, and the low-pressure turbine 9 drives a different load device in another possible configuration. In another possible configuration, the high-pressure turbine 3, the intermediate-pressure turbine 6, and the low-pressure turbine 9 are divided into two groups (i.e. a group of two turbines and a group of one turbine), and each of the groups drives one load device. Furthermore, although the boiler is included as the steam source 1 in the illustrated configuration, a heat recovery steam generator (HRSG) that uses waste heat of gas turbines is adopted as the steam source 1 in another possible configuration. That is, the present invention may be applied to a combined cycle power generation facility. Nuclear reactors are included in examples of the steam source 1.

—Steam Turbine—

Figure 2:
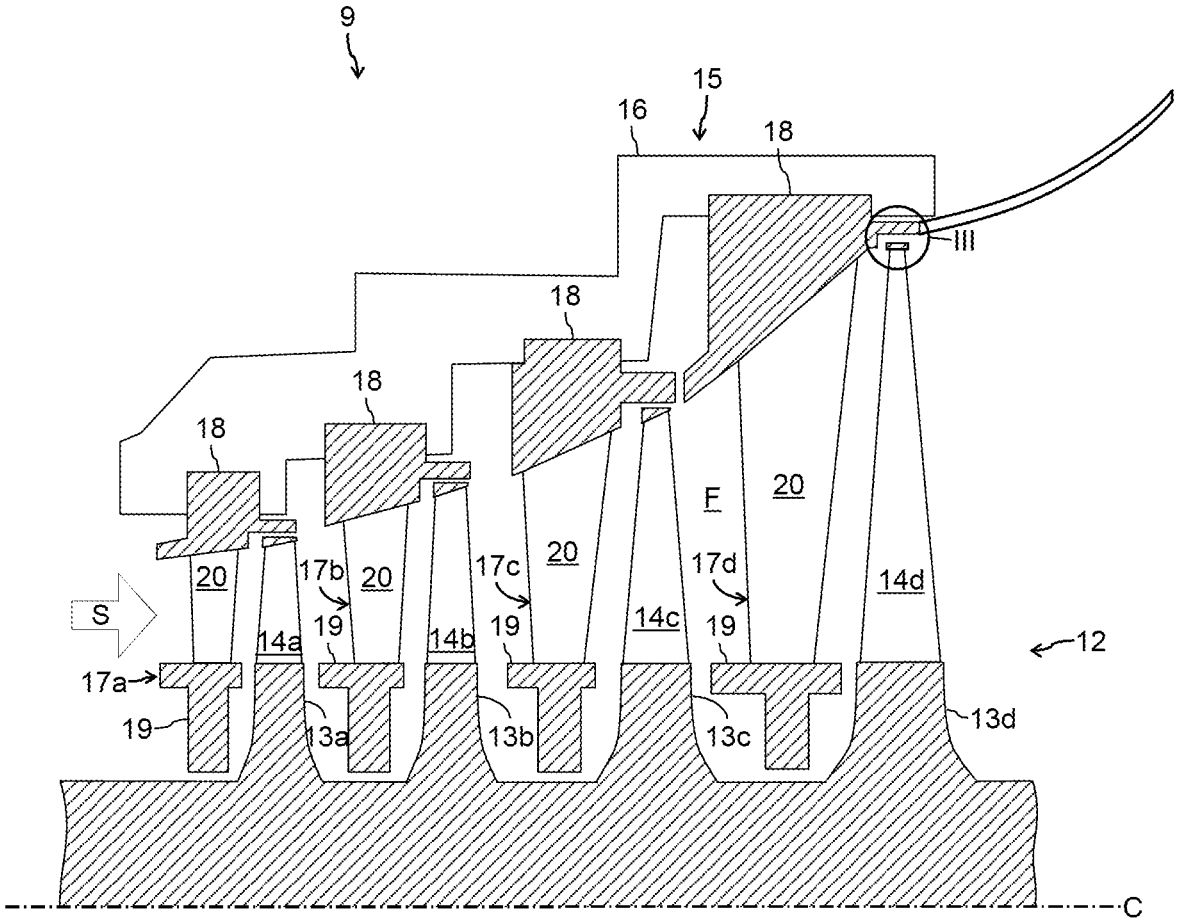
FIG. 2 is a cross-sectional view of a steam turbine according to the one embodiment of the present invention.

FIG. 2 is a cross-sectional view of the low-pressure turbine 9. As illustrated in the figure, the low-pressure turbine 9 includes the turbine rotor 12 described above and a stator 15 covering the turbine rotor 12. The diffuser is arranged at the outlet of the stator 15. Note that in this specification of the present application, the rotation direction of the turbine rotor 12 is defined as a "circumferential direction," the direction in which the rotation center line C of the turbine rotor 12 lies is defined as an "axial direction," and the radial direction of the turbine rotor 12 is defined as a "radial direction."

The turbine rotor 12 includes rotor disks 13*a* to 13*d* and moving blades 14*a* to 14*d*. The rotor disks 13*a* to 13*d* are disk-like members that are arranged to overlap one another in the axial direction. The rotor disks 13*a* to 13*d* are superimposed on spacers (not illustrated) such that the rotor disks 13*a* to 13*d* and the spacers alternate in some cases. A plurality of each of the moving blades 14*a* to 14*d* are provided at constant intervals in the circumferential direction on the outer circumferential surface of a corresponding one of the rotor disks 13*a* to 13*d*. The moving blades 14*a* to 14*d* extend radially outward from the outer circumferential surfaces of the rotor disks 13*a* to 13*d*, and face the annular working fluid flow passage F. The fluid energy of the steam S flowing through the working fluid flow passage F is converted into rotational energy by the moving blades 14*a* to 14*d*, and the turbine rotor 12 rotates integrally around the rotation center line C.

The stator 15 includes a casing 16 and diaphragms 17*a* to 17*d*. The casing 16 is an tubular member forming the outer circumferential wall of the low-pressure turbine 9. The diaphragms 17*a* to 17*d* are attached to an inner circumference section of the casing 16. The diaphragms 17*a* to 17*d* are segments each of which is formed integrally including a diaphragm outer ring 18, a diaphragm inner ring 19, and a plurality of blade sections 20. A plurality of each of the diaphragms 17*a* to 17*d* being arrayed in the circumferential direction form an annular shape.

The diaphragm outer rings 18 are members defining, at their inner circumferential surfaces, the outer circumference of the working fluid flow passage F, and are supported by the inner circumferential surface of the casing 16. The diaphragm outer rings 18 form annular shapes. In the present embodiment, the inner circumferential surfaces of the diaphragm outer rings 18 are inclined radially outward toward the downstream side (the right side in FIG. 2). The diaphragm inner rings 19 are members defining, by their outer circumferential surfaces, the inner circumference of the working fluid flow passage F, and are arranged on the radially inner side of the diaphragm outer rings 18. The diaphragm inner rings 19 form annular shapes (cylindrical shapes in the present example). A plurality of the blade sections 20 are arrayed in the circumferential direction, extend in the radial direction, and couple the diaphragm inner rings 19 to the diaphragm outer rings 18.

Note that diaphragms and moving blades adjacent to the diaphragms on the downstream side of the diaphragms form one stage. In the present embodiment, the diaphragms 17*a* and the moving blades 14*a* form the first stage (initial stage), the diaphragms 17*b* and the moving blades 14*b* form the second stage, the diaphragms 17*c* and the moving blades 14*c* form the third stage, and the diaphragms 17*d* and the moving blades 14*d* form the fourth stage (final stage).

—Diaphragm Outer Ring—

Figure 3:
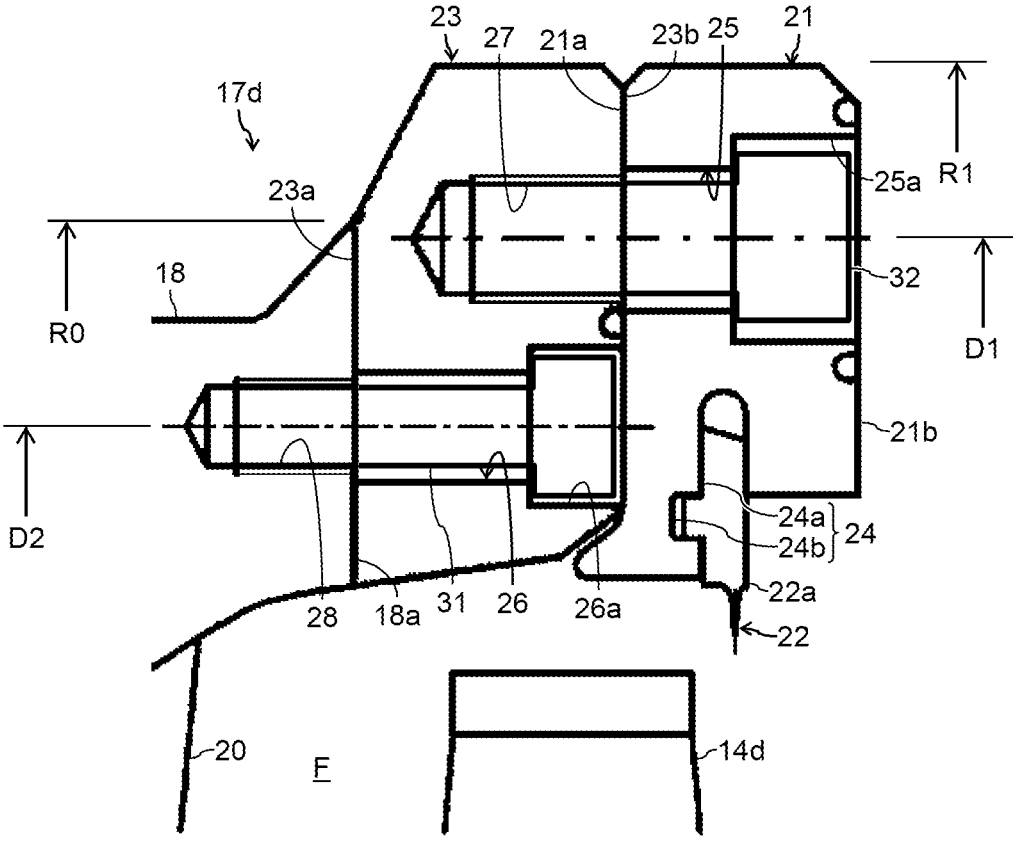
FIG. 3 is an enlarged view of a section III in FIG. 2, and a figure representing a structure of a main part of a diaphragm according to the one embodiment of the present invention.

FIG. 3 is an enlarged view of a section III in FIG. 2, and a cross-sectional view representing the structure of a main part of a diaphragm according to the one embodiment of the present invention. The structure explained below is applied to the diaphragm 17*d* of at least one stage (e.g. a wet stage where drain water easily adheres onto moving blade surfaces; typically the final stage of the low-pressure turbine 9). Regarding the application of the structure to stages in the low-pressure turbine 9 other than the fourth stage, the structure is more applicable to stages that are closer to the final stage, that is, the ascending order of applicability is the diaphragms 17*c*, 17*b*, and 17*a*. Although the diaphragm 17*d* in the fourth stage in the low-pressure turbine 9 is an application subject in the illustrated case explained by using the FIG. 3, the same structure is used also in cases where application targets are diaphragms of the other stages. If necessary, the structure can be applied also to diaphragms of the high-pressure turbine 3 and the intermediate-pressure turbine 6.

As illustrated in FIG. 3, the diaphragm 17*d* includes a collector ring 21, a seal fin 22, and an adapter ring 23, in addition to the diaphragm outer ring 18, the diaphragm inner ring 19 (FIG. 2), and the blade section 20.

The collector ring 21 is an annular member that is arranged on the downstream side of the diaphragm outer ring 18, and retains the seal fin 22. The collector ring 21 is divided into a plurality of sections in the circumferential direction (e.g. divided into two, an upper half and a lower half section, or divided into four to six). The external radius R1 of the collector ring 21 is larger than the external radius R0 of a downstream end section of the diaphragm outer ring 18. The internal radius of the collector ring 21 is approximately the same as that of the downstream end section of the diaphragm outer ring 18. In addition, an upstream end surface 21*a* and a downstream end surface 21*b* of the collector ring 21 are flat surfaces that are parallel to a plane orthogonal to the rotation center line C (FIG. 2) of the turbine rotor 12.

The inner circumferential surface of the collector ring 21 is provided with a slit 24 extending in the circumferential direction. The slit 24 has a T-shaped cross-section formed with a radial groove 24*a* extending in the radial direction and an axial groove 24*b* extending in the axial direction. The radial groove 24*a* has a role of restricting the movement of the seal fin 22 in the axial direction. The axial groove 24*b* has a role of restricting the movement of the seal fin 22 in the radial direction. The axial groove 24*b* is positioned on the radially outer side of the inner circumferential surface of the collector ring 21. The axial groove 24*b* is separated from the working fluid flow passage F by a structure material of the collector ring 21, and does not face the working fluid flow passage F.

The collector ring 21 is provided with through-holes 25 penetrating the collector ring 21 in the axial direction at intervals in the circumferential direction. A through-hole 25 is provided with a counterbore 25*a* on the downstream end surface side of the collector ring 21. The entirety of the through-hole 25 including the counterbore 25*a*, is positioned on the radially outer side of the slit 24 such that the through-hole 25 does not interfere with the slit 24 or the insufficiency of thickness does not occur. In addition, at least part of the through-hole 25 is positioned on the outer side of the external radius of the downstream end section of the diaphragm outer ring 18. The pitch circle diameter (P.C.D.) D1 of the through-holes 25 around the rotation center line C (FIG. 2) is set larger than the pitch circle diameter D2 of through-holes 26 mentioned below (the pitch circle of the through-holes 25 is positioned on the radially outer side of the pitch circle of the through-holes 26).

The seal fin 22 protrudes radially inward from the inner circumferential surface of the collector ring 21, and seals the gap between the tip surface of the moving blade 14*d* and the inner circumferential surface of the collector ring 21. This seal fin 22 is an annular member, and is divided into a plurality of sections in the circumferential direction (e.g. divided into two, an upper half and a lower half section, or divided into four to six). The seal fin 22 includes a root section 22*a* having a radial spill strip (RSS) structure formed to have a T-shaped cross-section that matches the slit 24 of the collector ring 21. The seal fin 22 is fixed to the inner circumference section of the collector ring 21 by fitting the root section 22*a* into the slit 24 described above in the circumferential direction.

Note that although the state at the time of suspension of operation is represented in FIG. 3, and the seal fin 22 is positioned on the downstream side of the moving blade 14*d*, the positions of the seal fin 22 and the moving blade 14*d* in the axial position overlap during the operation due to the thermal expansion of the turbine rotor 12. In addition, although one line of the seal fin 22 is illustrated in FIG. 3, the structure of the seal fin 22 can be replaced with a structure including a plurality of lines of fins in the axial direction in a case where a plurality of lines of fins are to be installed in the axial direction.

The adapter ring 23 is interposed between the diaphragm outer ring 18 and the collector ring 21, and is used for attaching the collector ring 21 to the diaphragm outer ring 18 having a radius smaller than the collector ring 21. Although the adapter ring 23 is desirably a seamless ring made of one body, the adapter ring 23 may have a structure divided into a plurality of sections in the circumferential direction similarly to the collector ring 21 (e.g. a structure divided into two, an upper half and a lower half section, or divided into four to six). In addition, the adapter ring 23 has an external radius that is approximately the same as that of the collector ring 21, and larger than the external radius of the downstream end section of the diaphragm outer ring 18. The internal radius of the adapter ring 23 is approximately the same as that of the downstream end section of the diaphragm outer ring 18. An upstream end surface 23*a* and a downstream end surface 23*b* of the adapter ring 23 are flat surfaces that are parallel to a plane orthogonal to the rotation center line C (FIG. 2) of the turbine rotor 12.

Bolt holes (screw holes) 27 are provided in the downstream end surface 23*b* of the adapter ring 23 at intervals in the circumferential direction corresponding to the through-holes 25 of the collector ring 21. In addition, the adapter ring 23 is provided with the through-holes 26 penetrating the adapter ring 23 in the axial direction at intervals in the circumferential direction. The positions of the through-holes 26 correspond to bolt holes (screw holes) 28 provided in a downstream end surface 18*a* of the diaphragm outer ring 18 at intervals in the circumferential direction. The downstream end surface 18*a* of the diaphragm outer ring 18 also is a flat surface parallel to a plane orthogonal to the rotation center line C. Each through-hole 26 is provided with a counterbore 26*a* on the downstream end surface side of the adapter ring 23. As mentioned before, the pitch circle diameter D2 of the through-holes 26 around the rotation center line C (FIG. 2) is smaller than the pitch circle diameter D1 of the through-holes 25 of the collector ring 21 (i.e. the pitch circle diameter of the bolt holes 27). In the present embodiment, the positions, in the radial direction, of the through-holes 26 or counterbores 26*a* of the adapter ring 23 at least partially overlap the root section 22*a* of the seal fin 22. That is, when seen in the axial direction, the through-holes 26 or counterbores 26*a* of the adapter ring 23 at least partially overlap the root section 22*a* of the seal fin 22.

The diaphragm outer ring 18 and the adapter ring 23 are mutually coupled by a plurality of first bolts 31 inserted in the axial direction from the downstream side. The first bolts 31 are hex socket head cap bolts, for example, and are screwed into the bolt holes 28 of the diaphragm outer ring 18 via the through-holes 26 of the adapter ring 23. Head sections of the first bolts 31 are housed in the counterbores 26*a* of the adapter ring 23 so as not to protrude from the downstream end surface 23*b* of the adapter ring 23 toward the collector ring 21. By fastening each first bolt 31, the facing surfaces of the diaphragm outer ring 18 and the adapter ring 23 (i.e. the downstream end surface 18*a* and the upstream end surface 23*a*) are kept together tightly to form seal surfaces that are continuous in the circumferential direction. The first bolts 31 are orthogonal to the seal surfaces of the diaphragm outer ring 18 and the adapter ring 23, and the fastening force of the first bolts 31 is efficiently converted into the contact pressure of the seal surfaces.

The adapter ring 23 and the collector ring 21 are mutually coupled by a plurality of second bolts 32 inserted in the axial direction from the downstream side at positions that are on the outer circumference side of the root section 22*a* of the seal fin 22. The second bolts 32 are hex socket head cap bolts, for example, and are screwed into the bolt holes 27 of the adapter ring 23 via the through-holes 25 of the collector ring 21. In the present embodiment, the second bolts 32 are positioned on the outer circumference side of the first bolts 31. Head sections of the second bolts 32 are housed in the counterbores 25*a* of the collector ring 21 so as not to protrude from the downstream end surface 21*b* of the collector ring 21. By fastening each second bolt 32, facing surfaces of the adapter ring 23 and the collector ring 21 (i.e. the downstream end surface 23*b* and the upstream end surface 21*a*) are fastened together. The second bolts 32 are orthogonal to the facing surfaces of the adapter ring 23 and the collector ring 21.

In the manner mentioned above, the collector ring 21 retaining the seal fin 22 is attached on the downstream side of the diaphragm outer ring 18 via the adapter ring 23. By attaching the seal fin 22, leakage of the steam S via gap flow passages on the outer circumference side of the moving blades 14*d* is suppressed, and the deterioration of the turbine efficiency is suppressed. Furthermore, the seal surface described above of the adapter ring 23 surrounds the circumference of the working fluid flow passage F seamlessly, and leakage of the steam S via the space between the facing surfaces of the diaphragm outer ring 18 and the adapter ring 23 is also suppressed.

—Manufacturing Method—

Figure 4:
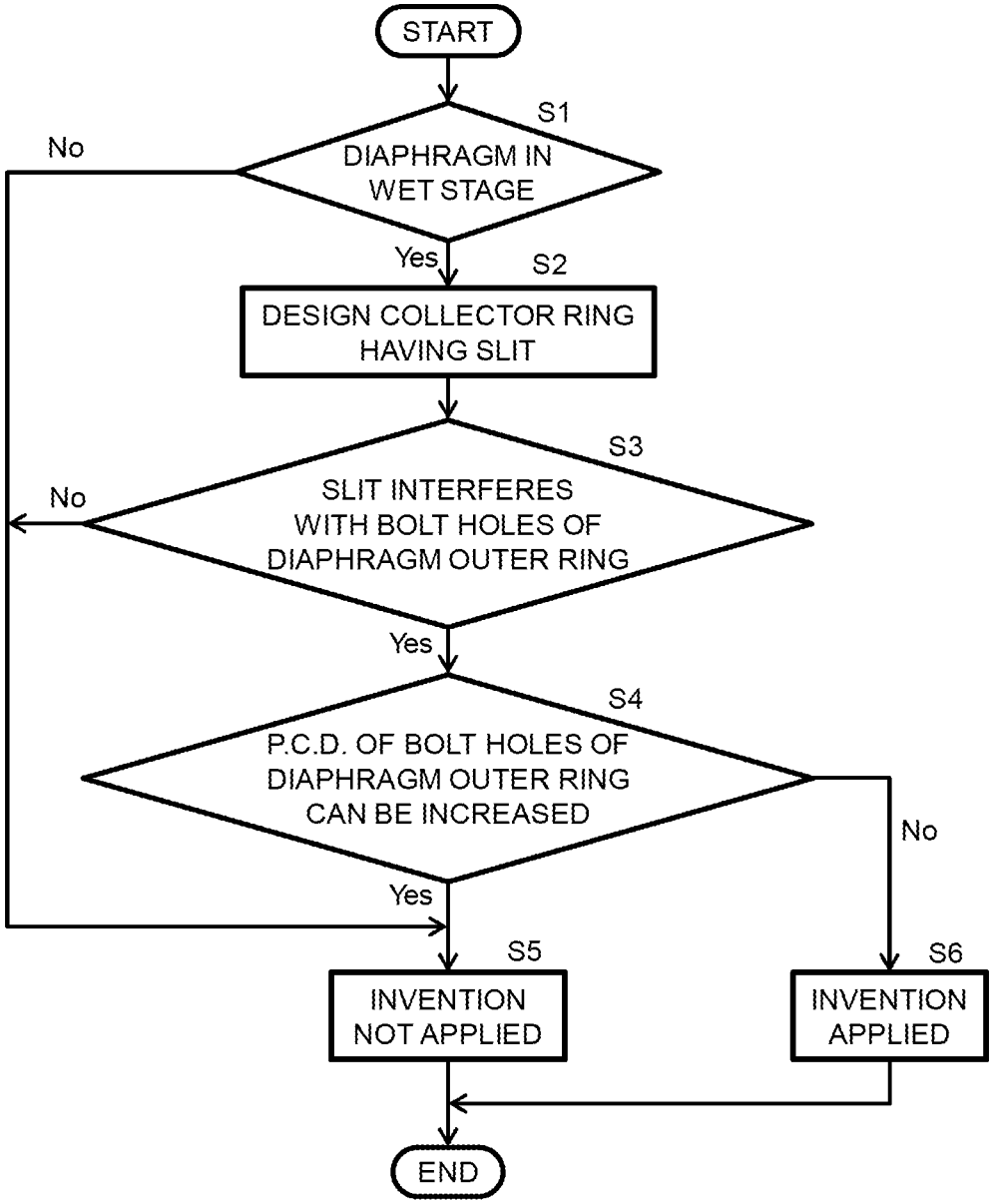
FIG. 4 is a flowchart representing a procedure for determination about application of a diaphragm manufacturing method of the present invention.
Figure 5:
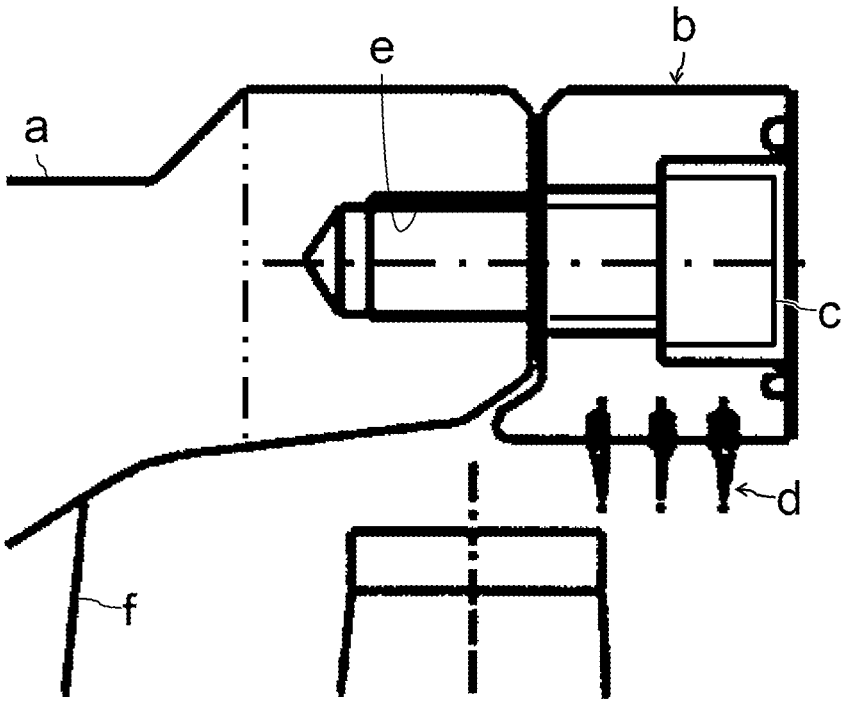
FIG. 5 is an explanatory diagram of the diaphragm manufacturing method according to the one embodiment of the present invention, and is a figure representing a diaphragm before modification.

FIG. 4 is a flowchart representing a procedure for determination about application of a diaphragm manufacturing method of the present invention, and FIG. 5 is an explanatory diagram of the diaphragm manufacturing method according to the one embodiment of the present invention, and is a figure representing a diaphragm before modification. The diaphragm illustrated in FIG. 5 is one that is used in an existing steam turbine facility, and an example of converting the structure of a seal fin to the RSS structure is explained by using, as an original diaphragm, the diaphragm illustrated in the figure.

The diaphragm illustrated in FIG. 5 is a diaphragm for a steam turbine, and has a diaphragm inner ring (not illustrated), a diaphragm outer ring a, and a blade section f that are formed integrally. A collector ring b is coupled to the downstream side of the diaphragm outer ring a by a bolt c. The bolt c is inserted in the axial direction from the side where the collector ring b is located, and screwed into the diaphragm outer ring a. Seal fins d are embedded in the inner circumferential surface of the collector ring b. The seal fins d are fixed to the collector ring b by crimping. When a new diaphragm including seal fins having the RSS structure is manufactured by using such an existing diaphragm as an original diaphragm, it is examined first through the procedure illustrated in FIG. 4 whether to or not to apply the present invention.

Step S1

First, it is determined whether the diaphragm illustrated in FIG. 5 belongs to a wet stage, that is, whether it is required for the structure of the seal fins d to be converted to the RSS structure. If the RSS structure has already been applied to the seal fins d first of all, it is not necessary to apply the present invention, and the procedure proceeds to Step S5, and the examination ends without applying the present invention.

Step S2

In a case where the structure of the seal fins d of the diaphragm illustrated in FIG. 5 is to be converted to the RSS structure, the procedure proceeds to Step S2, and a seal fin having the RSS structure (the seal fin 22 illustrated in FIG. 3) and a new collector ring having a slit to retain the seal fin (the collector ring 21 illustrated in FIG. 3) are designed.

Step S3

Next, it is determined whether the slit of the new collector ring (the slit 24 illustrated in FIG. 3) interferes with fastening holes e of the diaphragm outer ring a, that is, whether the slit and the fastening holes e overlap when seen in the axial direction. If the slit does not overlap the fastening holes e, this means that the fastening holes e can be used for attachment of the new collector ring, and thus it is not necessary to separately prepare an adapter ring (the adapter ring 23 illustrated in FIG. 3). In this case, the procedure proceeds to Step S5, and the examination ends.

Step S4

In a case where the slit of the new collector ring interferes with the fastening holes e of the diaphragm outer ring a or the insufficiency of thickness occurs, it is determined whether it is possible to increase the pitch circle diameter and whether new bolt holes can be formed by processing in the downstream end surface of the diaphragm outer ring a. Also in a case where there is a sufficient space in the external radius (i.e. the thickness) of the diaphragm outer ring a, and new bolt holes can be formed by processing, it is not necessary to separately prepare an adapter ring. The new collector ring can be attached directly to the diaphragm outer ring a by forming new bolt holes by processing through the diaphragm outer ring a and providing through-holes corresponding to the bolt holes to the new collector ring. In this case also, the procedure proceeds to Step S5, and the examination ends.

Step S6

In a case where new bolt holes cannot be provided in the downstream end surface of the diaphragm outer ring a, the procedure proceeds to Step S6, it is determined that the present invention is to be applied, and the examination ends.

In a case where it is determined that the present invention is to be applied, a procedure of modifying the diaphragm illustrated in FIG. 5 and manufacturing the diaphragm 17*d* illustrated in FIG. 3 generally includes a step of processing the diaphragm outer ring, a step of fabricating parts, and an assembly step.

At the step of processing the diaphragm outer ring, a downstream end section of the diaphragm outer ring a is eliminated and the diaphragm outer ring 18 illustrated in FIG. 3 is formed such that the seal fin 22 is located at a desired position when the collector ring 21 is attached via the adapter ring 23. In the present example, a portion of the diaphragm outer ring a on the right side of the two-dot chain line illustrated in FIG. 5 is eliminated. However, the amount of the elimination of the downstream end section of the diaphragm outer ring a can be set as desired within such a range that interference with the blade section f does not occur. In a case where the downstream end section of the diaphragm outer ring a is to be eliminated, a method can be adopted in which the downstream end section of the diaphragm outer ring a is cut by machining to finish the downstream end surface 18*a*, for example. It is also possible to finish the downstream end surface 18*a* by machining after roughly cutting the downstream end section of the diaphragm outer ring a by gas cutting, but finishing the downstream end surface 18*a* only by machining makes it possible to suppress the thermal deformation of the diaphragm outer ring 18 due to heat input. In addition, the bolt holes 28 are formed in the downstream end surface 18*a* of the diaphragm outer ring 18 by processing.

At the step of fabricating parts, the collector ring 21, the seal fin 22, and the adapter ring 23 illustrated in FIG. 3 are fabricated. This step of fabricating parts may be implemented before or after the step of processing the diaphragm outer ring, or can be implemented concurrently in parallel. The order of the fabrication of the collector ring 21, the seal fin 22, and the adapter ring 23 is not particularly limited. The collector ring 21, the seal fin 22, and the adapter ring 23 may be fabricated in any order, and there are certainly no problems even if a plurality of them are fabricated concurrently.

At the assembly step, the seal fin 22 having the RSS structure is fit into the slit 24 of the collector ring 21 in the circumferential direction. In addition, the adapter ring 23 is arranged on the downstream side of the diaphragm outer ring 18, the plurality of first bolts 31 are inserted in the axial direction from the downstream side, and the adapter ring 23 is coupled with the diaphragm outer ring 18. Then, the collector ring 21 is arranged on the downstream side of the adapter ring 23, the plurality of second bolts 32 are inserted in the axial direction from the downstream side, and the collector ring 21 is coupled with the adapter ring 23.

Comparative Example

Figure 6:
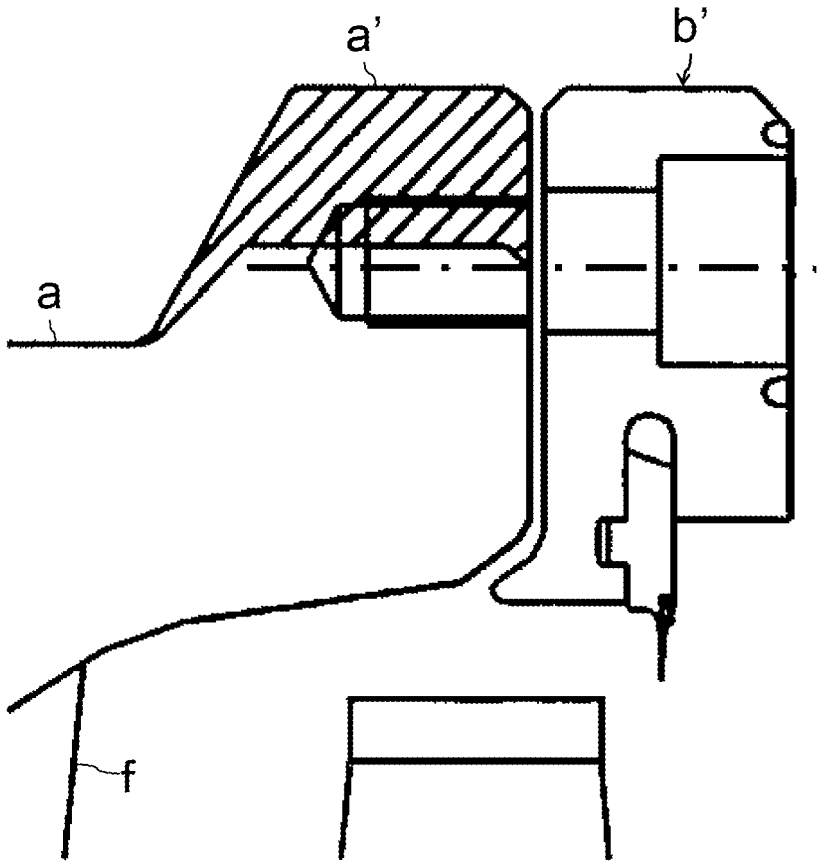
FIG. 6 is a figure representing a structure of a diaphragm fabricated by modifying the diaphragm illustrated in FIG. 3 by a manufacturing method according to a comparative example.

FIG. 6 is a figure representing the structure of a diaphragm fabricated by modifying the diaphragm illustrated in FIG. 3 by a manufacturing method according to a comparative example. For comparison, the size and the shape of a collector ring b' illustrated in FIG. 6 are made identical to those of the collector ring 21 illustrated in FIG. 3.

In FIG. 4, the present invention is applied to modify the structure of the seal fins of the existing diaphragm to the structure illustrated in FIG. 3 in a case where the pitch circle diameter of the fastening holes e of the diaphragm outer ring a cannot be increased when the structure of the seal fins of the diaphragm is converted to the RSS structure. However, conventionally, in a case where the external radius of the diaphragm outer ring a is insufficient, and the new collector ring b' to retain a seal fin having the RSS structure cannot be attached as illustrated in FIG. 6, the design of the diaphragm outer ring is changed to one having a large external radius. The diaphragm outer ring a excluding the hatched portion in FIG. 6 is an existing diaphragm outer ring, and a diaphragm outer ring a' including the hatched portion and having a larger radius is a diaphragm outer ring after the design change. In this case, the collector ring b' can be attached without any problems, but since the diaphragm outer ring is part of the diaphragm having a configuration made of one body, the design change of the diaphragm outer ring makes it necessary to newly fabricate the entirety of a diaphragm including its blade section and diaphragm inner ring. The manufacturing of the diaphragm having modified specifications takes a long period. In addition, although the outer circumferential section of the existing diaphragm outer ring a may be subjected to weld overlay as one possible solution, this is not desirable since there is a concern over large heat input and resulting thermal deformation.

Effects (1) In the present embodiment, the structure of the seal fin 22 is converted to the RSS structure, thereby increasing a root section thereof to be inserted into the collector ring 21, and enabling enhancement of the reliability against erosion of the structure to fix the seal fin 22. In addition, since the downstream end section of the diaphragm outer ring is eliminated, and a great portion of the existing diaphragm can be used, it can be expected to significantly reduce the construction period for a conversion of the structure of the seal fin in the diaphragm to the RSS structure.

In addition, since the diaphragm outer ring 18, the adapter ring 23, and the collector ring 21 are fastened together by bolts, thermal deformation can be suppressed, and the shape of the diaphragm can be finished highly precisely unlike in the case of welding.

(2) When seen in the axial direction, the first bolts 31 at least partially overlap the seal fin 22, and the head sections of the first bolts 31 are housed in the counterbores 26*a* provided to the adapter ring 23. By making a space in the radial direction shared by the first bolts 31 and the seal fin 22 in this manner, a sufficient space can be left for the bolt holes 27 provided for attachment of the collector ring 21 to the adapter ring 23. In addition, by providing the counterbores 26*a* to the adapter ring 23 and housing the head sections of the first bolts 31 in the counterbores 26*a*, interference of the head sections of the first bolts 31 with the facing surfaces of the adapter ring 23 and the collector ring 21 can be avoided. In addition, the counterbores 26*a* are sealed in by the collector ring 21 and the first bolts 31 are completely closed in in this configuration. Accordingly, loosening of the first bolts 31 can also be suppressed because the movement of the first bolts 31 is restricted by the collector ring 21.

(3) Since the seal surfaces of the diaphragm outer ring 18 and the adapter ring 23 are flat surfaces that are orthogonal to the first bolts 31, the fastening force of the first bolts 31 can be converted into the contact pressure at the seal surfaces of the diaphragm outer ring 18 and the adapter ring 23 without waste. Thereby, favorable sealing performance of the seal surfaces of the diaphragm outer ring 18 and the adapter ring 23 can be ensured.

DESCRIPTION OF REFERENCE CHARACTERS

17*a* to 17*d*: Diaphragm
18: Diaphragm outer ring

18*a*: Downstream end surface (a facing surface between the diaphragm outer ring and the adapter ring; a seal surface)
19: Diaphragm inner ring
20: Blade section
21: Collector ring
21*a*: Upstream end surface (a facing surface between the adapter ring and the collector ring)
22: Seal fin
23: Adapter ring
23*a*: Upstream end surface (a facing surface between the diaphragm outer ring and the adapter ring; a seal surface)
23*b*: Downstream end surface (a facing surface between the adapter ring and the collector ring)
26*a*: Counterbore
31: First bolt
32: Second bolt
R1: External radius of the collector ring
R2: External radius of the diaphragm outer ring

The invention claimed is:

1. A steam turbine diaphragm comprising:
a diaphragm inner ring;
a diaphragm outer ring; and
a blade section that are formed integrally, the steam turbine diaphragm further comprising:
a collector ring arranged on a downstream side of the diaphragm outer ring;
a seal fin having a radial spill strip structure fit into the collector ring; and
an adapter ring interposed between the diaphragm outer ring and the collector ring, wherein
the diaphragm outer ring and the adapter ring are mutually coupled by a plurality of first bolts inserted in an axial direction from a downstream side, and facing surfaces of the diaphragm outer ring and the adapter ring are kept together tightly and sealed, and
the collector ring and the adapter ring have external radii larger than an external radius of the diaphragm outer ring, and are mutually coupled by a plurality of second bolts that are inserted in the axial direction from the downstream side at positions on an outer circumference side of the seal fin.

2. The diaphragm according to claim 1, wherein at least part of each of the first bolts overlaps the seal fin when seen in the axial direction, and the adapter ring is provided with counterbores in which head sections of the first bolts are housed.

3. The diaphragm according to claim 1, wherein seal surfaces of the diaphragm outer ring and the adapter ring are flat surfaces orthogonal to the first bolts.

4. A steam turbine in which the diaphragm according to claim 1 is applied to at least one stage.

5. A diaphragm manufacturing method of manufacturing a new diaphragm including a seal fin having a radial spill strip structure by using, as an original diaphragm, a steam turbine diaphragm including a diaphragm inner ring, a diaphragm outer ring, and a blade section that are formed integrally, the diaphragm manufacturing method comprising:
fabricating a collector ring and an adapter ring having external radii larger than an external radius of the diaphragm outer ring;
fitting the seal fin into the collector ring;
eliminating a downstream end section of the diaphragm outer ring;
arranging the adapter ring on a downstream side of the diaphragm outer ring, and inserting a plurality of first bolts in an axial direction from a downstream side to couple the adapter ring to the diaphragm outer ring; and
arranging the collector ring on a downstream side of the adapter ring, and inserting a plurality of second bolts in the axial direction from the downstream side at positions on an outer circumference side of the seal fin to couple the collector ring to the adapter ring.

* * * * *